US006713701B2

(12) United States Patent
Miyako et al.

(10) Patent No.: US 6,713,701 B2
(45) Date of Patent: Mar. 30, 2004

(54) SWITCH APPARATUS

(75) Inventors: Mamoru Miyako, Aichi (JP); Naoyuki Yokoe, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 0 days.

(21) Appl. No.: 10/443,762

(22) Filed: May 23, 2003

(65) Prior Publication Data

US 2003/0221945 A1 Dec. 4, 2003

(30) Foreign Application Priority Data

May 29, 2002 (JP) ..... 2002-155523

(51) Int. Cl.[7] ..... H01H 19/00
(52) U.S. Cl. ..... 200/517; 200/5 R; 200/336
(58) Field of Search ..... 200/5 R, 4, 11 R, 200/11 D, 11 DA, 18, 512, 517, 564, 568, 336

(56) References Cited

U.S. PATENT DOCUMENTS

| | | | | | |
|---|---|---|---|---|---|
| 4,769,516 | A | * | 9/1988 | Allen | 200/5 R |
| 4,918,264 | A | * | 4/1990 | Yamamoto et al. | 200/5 R |
| 5,403,984 | A | * | 4/1995 | Ogawa | 200/517 |
| 5,412,165 | A | * | 5/1995 | Malone et al. | 200/5 R |
| 5,430,261 | A | * | 7/1995 | Malone | 200/1 B |

* cited by examiner

*Primary Examiner*—Michael A. Friedhofer
(74) *Attorney, Agent, or Firm*—Morgan, Lewis & Bockius LLP

(57) ABSTRACT

In a switch apparatus, moderating pieces (29) are engaged with moderation concave portions of a manipulator (30) by way of a displaceable portion (20) of an elastic member (18) having a movable-side contact (24) which is contacted/separated to/from a fixed-side contact owned by an insulating board. Thus, the moderation can be applied to the manipulations of the manipulator (30) without requiring a coil spring provided as an independent component of a conventional switch apparatus.

4 Claims, 3 Drawing Sheets

SWITCH APPARATUS

BACKGROUND OF THE INVENTION

The present invention is related to a switch apparatus capable of improving a moderating mechanism for applying moderation to manipulations of a manipulator.

Conventionally, such a moderating mechanism as shown in FIG. 3 has been generally proposed as a moderating mechanism of this sort of switch apparatus. In this general-purpose moderating mechanism, while reference numeral 1 shows a manipulator, this manipulator 1 is pivotally, or slidably manipulated along a direction of an arrow "A". In response to this manipulation, a movable-side contact (not shown) is contacted to and/or separated from a fixed-side contact (not shown). A plurality of moderation concave portions 2 and a plurality of moderation convex portions 3 are alternately formed along a manipulation direction of the manipulator 1 in a lower plane of this manipulator 1, as viewed in this drawing.

On the other hand, reference numeral 4 shows a case. A concave portion 5 is formed in this case 4 on the side of the manipulator 1. While a coil spring 6 is stored in this concave portion 5, a moderating piece 7 is energized by spring force (elastic force) of this coil spring 6 along an upper direction, as viewed in this drawing, and is engaged with one of the moderation concave portions 2.

As a result, when the manipulator 1 is manipulated in this construction, the moderation convex portion 3 pushes the moderating piece 7 to be sunk by resisting the energizing force 5 of the coil spring 6, and thus, this moderating piece 7 is caused to cross the moderation convex portion 3 which is located adjacent to the moderation concave portion 2 engaged with this moderating piece 7. Then, the coil spring 6 causes the moderating piece 7 to be engaged with the moderation concave portion 2 by way of restoration force of this coil spring 6. Since this operation is sequentially carried out along the manipulation direction of the manipulator 1, moderation may be applied to the manipulations of the manipulator 1.

In the above-described conventional switch apparatus, the coil spring 6 is required in order to engage the moderating piece 7 with the moderation concave portion 2 of the manipulator 1. Accordingly, a total number of structural components employed in the conventional switch apparatus is increased and a cumbersome operation is necessarily required so as to assemble these structural components, resulting in high manufacturing cost.

SUMMARY OF THE INVENTION

The present invention has been made to solve the above-explained problems, and therefore, has an object to provide such a switch apparatus. That is, in accordance with the switch apparatus of the present invention, a total number of structural components required in a moderating mechanism for applying moderation to manipulations of a manipulator can be reduced, these structural components can be easily assembled, and also, manufacturing cost thereof can be decreased.

In order to solve the aforesaid object, the invention is characterized by having the following arrangement.

First Aspect

A switch apparatus comprising:

an insulating board including a fixed contact;

an elastic member including a movable contact capable of being connected to the fixed contact, and including a displaceable portion which is elastically displaceable in a direction toward the insulating board;

a manipulator movable in a direction substantially perpendicular to the direction in which the displaceable portion is elastically displaced, including a moderation concave portion opposed to the elastic member;

a moderating piece disposed between the moderation concave portion and the displaceable portion, wherein the displaceable portion urges the moderation piece toward the moderation concave portion so that the moderation piece is engaged with the moderation concave portion.

Second Aspect

The switch apparatus according to the first aspect, wherein the elastic member includes a body, the displaceable portion and a thinner-thickness portion connecting the body to the displaceable portion, and the body of the elastic member is attached to the insulating board.

Third Aspect

The switch apparatus according to the first aspect further comprising a manipulator holder including a hole through which the moderating piece passes.

Fourth Aspect

The switch apparatus according to the first aspect, wherein the manipulator includes a plurality of the moderating concave portions and a plurality of moderating convex portion for pressing the moderating piece toward the elastic member, which are alternatively arranged.

DETAILED DESCRIPTION OF PREFERRED EMBODIMENTS

Figure 1:
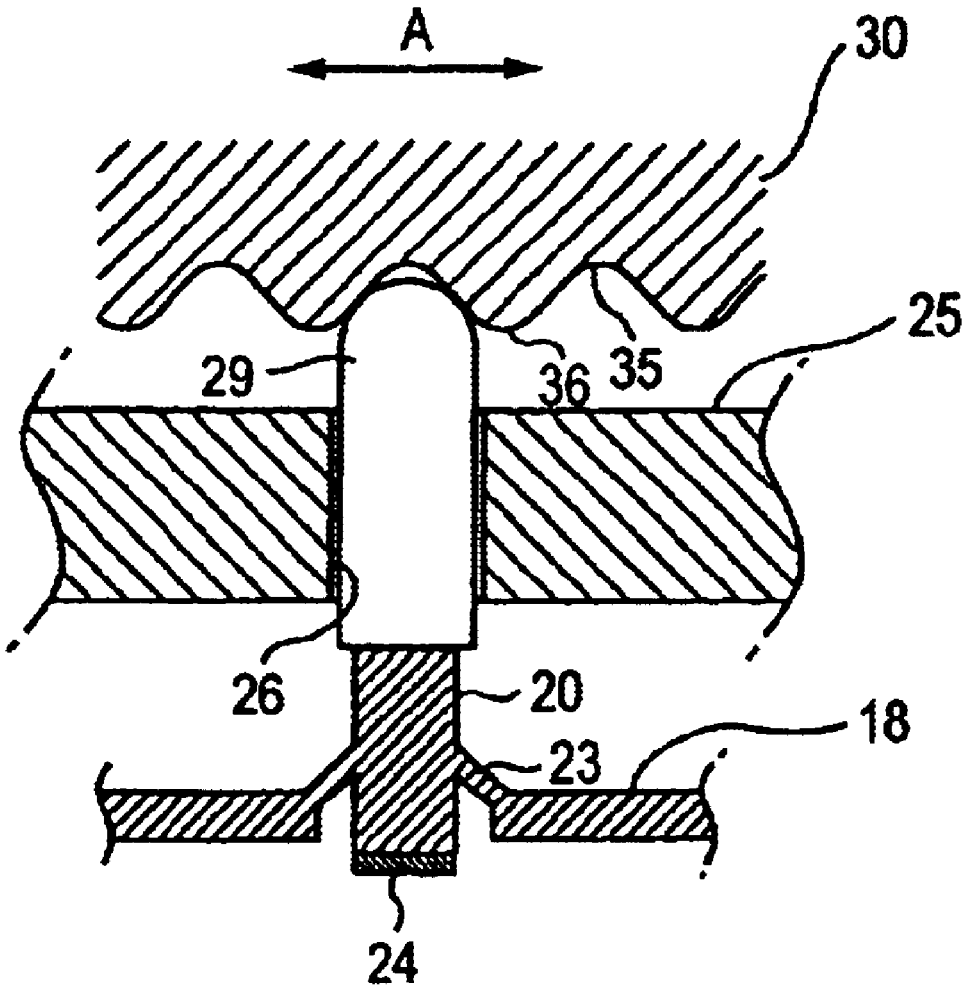
FIG. 1 is a cross-sectional view for indicating a major portion of a switch apparatus according to an embodiment of the present invention.
Figure 2:
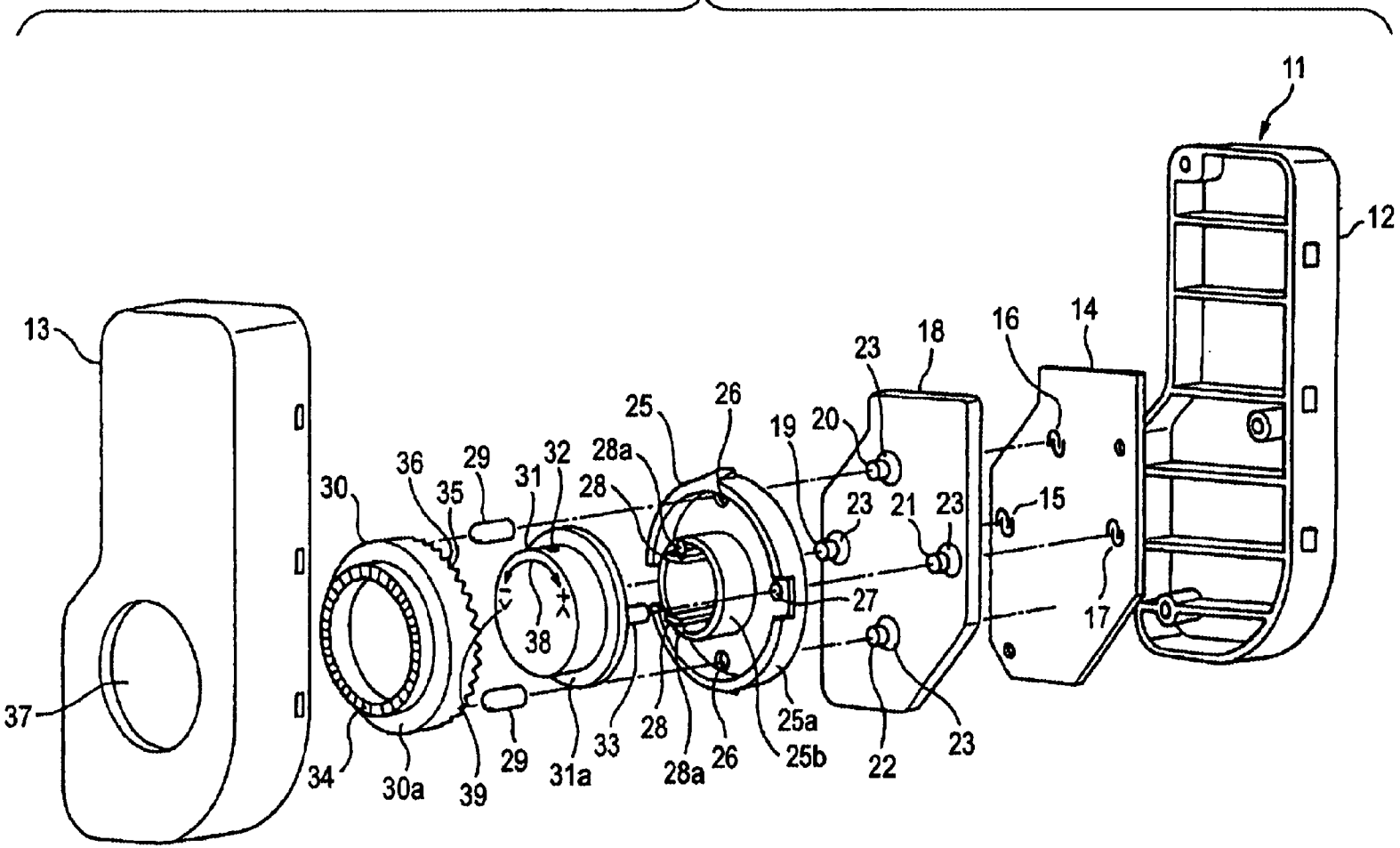
FIG. 2 is an exploded perspective view for indicating an entire structure of the switch apparatus of the embodiment.
Figure 3:
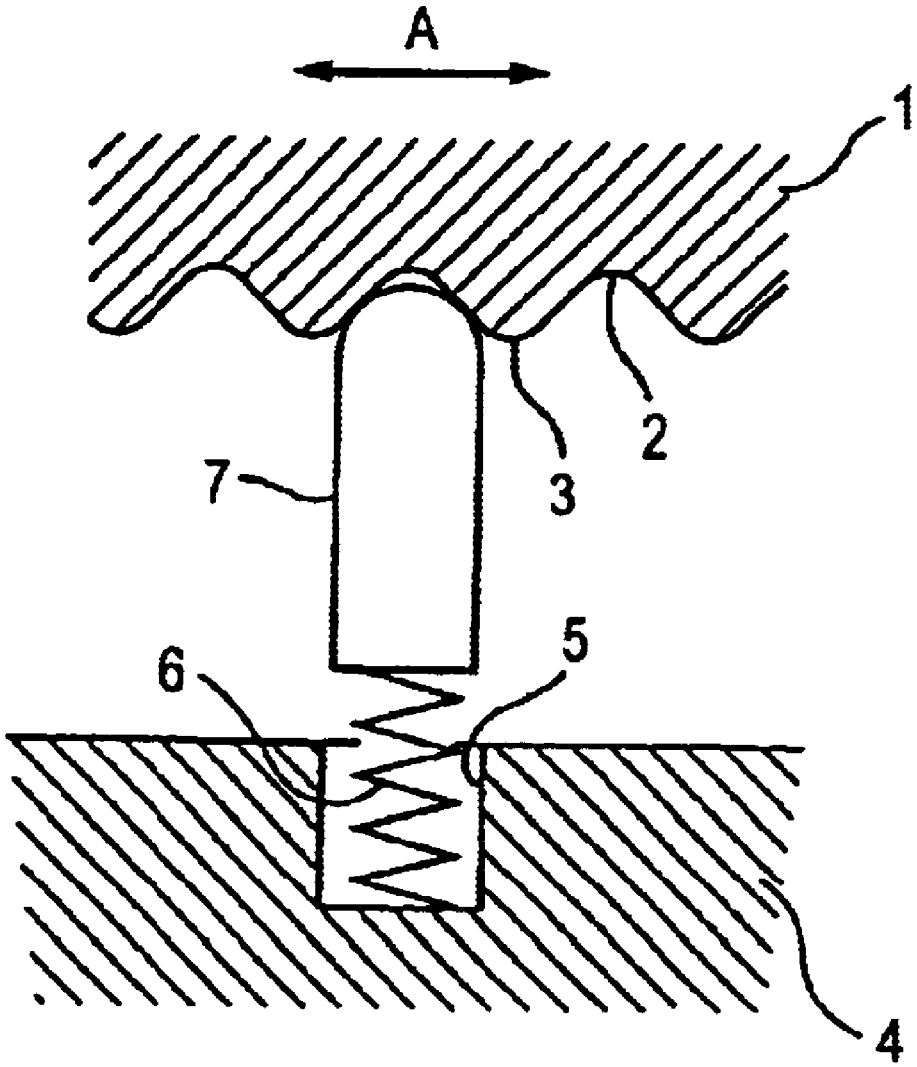
FIG. 3 is a cross-sectional view for showing the major portion of the conventional switch apparatus.

Referring now to FIG. 1 and FIG. 2, a description is made of a switch apparatus according to an embodiment of the present invention.

First, FIG. 2 indicates an entire construction of the switch apparatus according to this embodiment, more specifically, a switch apparatus used in a vehicle. A case 11 is constituted by a base 12 and a cover 13 which is coupled to this base 12.

An insulating board 14 is mounted on the base 12 in such a manner that this insulating board 14 is overlapped thereon. This insulating board 14 has fixed-side contacts 15, 16, 17, on a surface thereof located opposite to the side of the base 12. In this case, it should be noted that the insulating board 14 having these fixed-side contacts 15 to 17 is constituted by a circuit board such as a printed-circuit board.

An elastic member 18 is mounted on the insulating board 14 in such a manner that this elastic member 18 is overlapped thereon. This elastic member 18 corresponds to such an elastic member which is manufactured by an elastic material, for example, silicone rubber in the form of a plate shape identical to that of the insulating board 14. The elastic member 18 owns displaceable portions 19, 20, 21 at positions corresponding to the above-explained fixed-side contacts 15 to 17, and also, another displaceable portion 22 at another position. In this case, any of these displaceable portions 19 to 22 have the same cylindrical shapes. These displaceable portions 19 to 22 can be elastically displaced along the direction of the above-explained insulating board 14 by thinner-thickness portions 23 which are located around base portions of these displaceable portions 19 to 22.

Among these displaceable portions 19 to 22, both the displaceable portion 19 and the displaceable portion 21 constitute one pair, while being positioned at right and left positions in this drawing, whereas both the displaceable portion 20 and the displaceable portion 22 constitute one pair, while being positioned at upper and lower positions in this drawing. Furthermore, a movable-side contact (typically indicted as movable-side contact 24 of displaceable portion 20 in FIG. 1) is provided on a rear surface portion (not shown) of each of the displaceable portions 19 to 21 except for the displaceable portion 22. This movable-side contact 24 is contacted/separated to/from each of the above-described fixed-side contacts 15 to 17 due to displacement of the displaceable portions 19 to 21 exerted along the direction of the insulating board 14.

In contrast, reference numeral 25 indicates a manipulator holder having a doubled short cylindrical shape. In this manipulator holder 25, holes 26 are formed in an upper portion and a lower portion of a depth portion between an outer-sided cylinder portion 25*a* and an inner-sided cylinder portion 25*b* respectively, and holes 27 similar to the above-described holes 26 are formed in a right portion and a left portion of this depth portion (note that only one of holes 27 is shown). Further, supporting pieces 28 are formed on upper/lower portions inside of the inner-sided cylinder portion 25*b*, and also, supporting projections 28*a* are furthermore formed on upper/lower surfaces which are located opposite to the respective tip portions of the supporting pieces 28.

Then, moderating pieces 29 are inserted and penetrated through the former-mentioned holes 29 respectively. While one moderating piece 29 is formed in a cylindrical shape, a base edge portion of this moderating piece 29 on the side of the elastic member 18 constitutes a flat plane, whereas a tip portion of this moderating piece 29 on the opposite side of this elastic member 18 is formed in a spherical shape.

Next, reference numeral 30 indicates a first manipulator, and reference numeral 31 represents a second manipulator. Among these manipulators 30 and 31, the first manipulator 30 is formed in a short cylindrical shape having no lid, and the second manipulator 31 is formed in a short cylindrical shape having a lid, the diameter of which is one size of smaller than the diameter of the short cylindrical shape having no lid. In addition, the second manipulator 31 has holes 32 (only one of holes 32 is shown) in upper/lower portions of a peripheral portion, and also, owns projections 33 (only one of projections 33 is shown) on rear sides of right/left portions of a brim portion 31*a* of a base portion. The holes 32 are fitted to the supporting projections 28*a* of the manipulator holder 25, so that this second manipulator 31 is mounted in such a manner that this second manipulator 31 may be swung, while this supporting projection 28*a* is set as a center. Also, the projections 33 penetrate through the latter-mentioned holes 27 of the manipulator holder 25, and then are faced/contacted to the displaceable portions 19 and 20 of the elastic member 18.

On the other hand, the first manipulator 30 has a fine concave/convex portion 34 formed around an entire peripheral portion of the tip edge portion, and the fine concave/convex portion 34 may be easily hooked by fingers of a user. In this first manipulator 30, a large number of moderation concave portions 35 and a large number of moderation convex portions 36 are alternately provided on an entire peripheral portion of a rear surface of a brim portion 30*a* of a base portion thereof. This first manipulator 30 is fitted to the outer peripheral portion of the second manipulator 31, so that the moderation concave portions 35 (moderation convex portions 36) are faced to the tip portions of the above-explained moderating pieces 29.

Then, such a hole 37 is formed in the cover 13 of the above-explained case 11, while a dimension of this hole 37 is made slightly larger than a dimension of a major body portion of the first manipulator 37 except for the brim portion 30*a* of this first manipulator 37. This major body portion of the first manipulator 30 is inserted/penetrated into this hole 37 in combination with a major body portion of the second manipulator 31 except for the brim portion 31*a* of the second manipulator 31, and then, the manipulator holder 25 is mounted on the rear side of the cover 13.

Then, furthermore, an assembly unit constituted by the base 12, the insulating board 14, and the elastic member 18 is mounted on the rear side of the cover 13. As a result, the moderating pieces 29 are arranged between the moderation concave portions 35 of the first manipulator 30 and the displaceable portions 20, 22 of the elastic member 18 (see FIG. 1), and the moderating pieces 29 are depressed against these displaceable portions 20 and 22, so that each of the moderating pieces 29 may be engaged to each of the moderation concave portions 35. Also, under this condition, the first manipulator 30 is located opposite to the elastic member 18 via the manipulator holder 25, and the first manipulator 30 has the moderation concave portions 35 on the side opposite to this elastic member 18.

In this case, it should also be noted that the first manipulator 30 is employed so as to control a sound volume of an audio apparatus, and the second manipulator 31 is used so as to tune a broadcasting program within the switch apparatus for vehicle use. Accordingly, in this relationship, both an indication 38 for controlling a sound volume, and an indication 39 for tuning a broadcasting program are made on the tip surface of the second manipulator 31.

Thus, in the case of the switch apparatus with the above-described construction, when the first manipulator 30 is rotated around the peripheral portion of the second manipulator 31 in accordance with the indication 38 while the concave/convex portion 34 is hooked by a finger of a user, this first manipulator 30 is manipulated in parallel to the plane having the fixed-side contacts 15 to 17 of the insulating board 14, as indicated by an arrow "A" in FIG. 1. Then, since this first manipulator 30 is manipulated, the moderation convex portions 36 located adjacent to the moderation concave portions 32 which are engaged to the moderating pieces 29 may push and sink the moderating pieces 29 by resisting the elastic force of the displaceable portions 20, 22 of the elastic member 18, and thus, may cause the moderating pieces 29 to cross the moderation convex portions 36. Then, the displaceable portions 20 and 22 may cause the moderating pieces 29 to be engaged to the moderation concave portions 35 which are further located adjacent to the first-mentioned moderation concave portions 35 due to the restoration force thereof. This manipulation is sequentially carried out along the manipulation direction of the first manipulator 30, so that moderation may be applied to the first manipulator 30.

More specifically, as to the displaceable portion 20, every time this displaceable portion 20 is squeezed via the moderating piece 29 by the moderation convex portions 36 of the first manipulator 30, the movable-side contact 24 owned by this displaceable portion 20 is made contact to the fixed-side contact 16, so that the sound volume control of the audio apparatus is carried out. It should be understood that the displaceable portion 22 does not have the movable-side contact 24. As a consequence, this displaceable unit 22 may merely function in order to apply the moderation to the manipulations of the first manipulator 30, as explained above, and does not contribute the sound volume control of the audio apparatus. In other words, this displaceable portion 22 may constitute a so-called "dummy contact portion".

Furthermore, every time the second manipulator 31 depresses any one of the right and left portions thereof in accordance with the indication 39, either the displaceable portion 19 or the displaceable portion 21 of the elastic member 18 is depressed by the projection 33. As a result, the movable-side contact (not shown) is contacted to either the fixed-side contact 15 or the fixed-side contact 17, so that the tuning operation of the audio apparatus may be carried out.

As explained above, in the switch apparatus having such a structure, the moderating pieces 29 are engaged with the moderation concave portions 35 of the first manipulator 30 by way of the displaceable portions 20 and 22 of the elastic member 18, while this elastic member 18 owns the movable-side contacts (24) which are contacted/separated to/from the fixed-side contacts 15 to 17 owned by the insulating plate 14. Therefore, in accordance with this switch apparatus, the moderation can be applied to the manipulations of the first manipulator 30 without requiring such a coil spring provided as the independent component of the conventional switch apparatus. As a consequence, a total number of structural components employed in the moderating mechanism capable of applying the modulation to the manipulations of the first manipulator 30 can be reduced, so that the structural components can be easily assembled, and furthermore, the manufacturing cost of this switch apparatus can be decreased.

It should also be understood that although the manipulator (first manipulator 30) has been rotary-manipulated in the above-described embodiment, the present invention is not limited thereto. Alternatively, such a slidable manipulator may be employed. Also, the entire switch apparatus may be used in not only vehicles, but also audio apparatus of these vehicles.

In addition, both the displaceable portions 20 and 22 of the elastic member 18 may have the movable-side contacts 24, and also may not have the movable-side contacts 24 (namely, dummy contact portion). In other words, the movable-side contacts 24 may be provided irrespective of the displaceable portions 20 and 22 of the elastic member 18.

In addition, such a design as to whether or not the second manipulator 31 is employed may be properly changed, or modified to be executed within the technical scope of the present invention without departing from the gist of the present invention.

As previously explained, in accordance with the switch apparatus of the present invention, the moderation can be applied to the manipulations of the manipulator without requiring the coil spring as the independent structural component of the conventional switch apparatus. As a consequence, there are such effects that a total number of the structural components employed in the moderating mechanism capable of applying the modulation to the manipulations of the manipulator can be reduced, so that the structural components can be easily assembled, and furthermore, the manufacturing cost of this switch apparatus can be decreased.

What is claimed is:

1. A switch apparatus comprising:

an insulating board including a fixed contact;

an elastic member including a movable contact capable of being connected to the fixed contact, and a displaceable portion which is elastically displaceable in a direction toward the insulating board;

a manipulator movable in a direction substantially perpendicular to a direction in which the displaceable portion is elastically displaced, including a moderation concave portion opposed to the elastic member; and a moderating piece disposed between the moderation concave portion and the displaceable portion, wherein the displaceable portion elastically urges the moderation piece toward the moderation concave portion so that the moderation piece is engaged with the moderation concave portion.

2. The switch apparatus according to claim 1, wherein the elastic member includes a body attached to the insulating board, the displaceable portion and a thinner-thickness portion connecting the body to the displaceable portion.

3. The switch apparatus according to claim 1 further comprising a manipulator holder including a hole through which the moderating piece passes.

4. The switch apparatus according to claim 1, wherein the manipulator includes a plurality of the moderating concave portions and a plurality of moderating convex portions for pressing the moderating piece toward the elastic member, which are alternatively arranged.

* * * * *